US006547944B2

(12) United States Patent
Schreiber et al.

(10) Patent No.: US 6,547,944 B2
(45) Date of Patent: Apr. 15, 2003

(54) COMMERCIAL PLATING OF NANOLAMINATES

(75) Inventors: Chris M. Schreiber, Lake Elsinore, CA (US); Mordechay Schlesinger, Pittsburgh, PA (US); Robert Martinez, Rancho Cucamonga, CA (US); Haim Feigenbaum, Irvine, CA (US); William Robert Crumly, Anaheim, CA (US)

(73) Assignee: Delphi Technologies, Inc., Troy, MI (US)

( * ) Notice: Subject to any disclaimer, the term of this patent is extended or adjusted under 35 U.S.C. 154(b) by 43 days.

(21) Appl. No.: 09/733,735

(22) Filed: Dec. 8, 2000

(65) Prior Publication Data

US 2002/0070118 A1 Jun. 13, 2002

(51) Int. Cl.[7] ..... C25D 5/00; C25D 5/18; C25D 1/00

(52) U.S. Cl. ..... 205/96; 205/102; 205/103; 205/104; 205/67

(58) Field of Search ..... 205/96, 102, 103, 205/104, 67

(56) References Cited

U.S. PATENT DOCUMENTS 4,652,348 A * 3/1987 Yahalom et al. ..... 204/40
5,156,729 A * 10/1992 Mahrus et al. ..... 205/104
5,320,719 A * 6/1994 Lasbmore et al. ..... 205/104

OTHER PUBLICATIONS

Despic et al. ("Electrochemical Formation of Laminar Deposits of Controlled Structure and Composition", J. Electrochem. Soc., vol. 136, No. 6, Jun. 1989, pp. 1651–1657).*

Bird et al., "Giant Magnetoresistance in Electrodeposited Ni/Cu and Co/Cu Multilayers," *J. Electrochem. Chem.*, vol. 142, No. 4, pp. L65–L66, Apr. 1995.

Lashmore et al., "Electrodeposited Cu–Ni Textured Superlattices," *J. Electrochem. Soc.*, vol. 135, pp. 1218–1221, 1998 Month unavailable.

Parkin et al., "Oscillations in Exchange Coupling and Magnetoresistance in Metallic Superlattice Structures: Co/Ru, Co/Cr, and Fe/Cr," *Physical Review Letters*, vol. 64, No. 19, pp. 2304–2307, May 1990.

Simunovich et al., "Electrochemically Layered Copper-Nickel Nanocomposites with Enhanced Hardness," *J. Electrochem. Soc.*, vol. 141, No. 1, pp. L10–L11, Jan. 1994.

Tench et al., "Considerations in Electrodeposition of Compositionally Modulated Alloys," *J. Electrochem. Soc.*, vol. 137, No. 10, pp. 3061–3066, Oct. 1990.

Tench et al., "Enhanced Tensile Strength for Electrodeposited Nickel–Copper Multilayer Composites," *Metallurgical Transactions A*, vol. 15A, pp. 2039–2040, Nov. 1984.

Yahalom et al., "Formation of Composition–modulated Alloys by Electrodeposition," *Journal of Materials Science*, vol. 22, pp. 499–503, 1987 Month unavailable.

* cited by examiner

*Primary Examiner*—Edna Wong
(74) *Attorney, Agent, or Firm*—Thomas N. Twomey

(57) ABSTRACT

A method for forming a nanolaminate structure is provided which comprises plating a substrate with layers of substantially a first metal and substantially a second metal using an electrolytic plating process and controlling the plating current to obtain a desired current density at the cathode, which is maintained within a predefined range.

32 Claims, 2 Drawing Sheets

COMMERCIAL PLATING OF NANOLAMINATES

FIELD OF THE INVENTION

The present invention relates to a method for forming nanolaminate structures, and more particularly, to plating a substrate with nanolayers of a first metal and a second metal, using an electrolytic plating process.

BACKGROUND OF THE INVENTION

In many fields today, devices are being created from very small components. For example, in the electronics field, the size of integrated circuits and other electronic components is constantly being reduced. To support and interconnect these and other components, as well as to provide small-scale structural components, there is growing need for structural components with desired mechanical characteristics, such as modulus of elasticity, elongation, and/or yield strength, with the required mechanical characteristic dependent on the particular application.

Given the relatively small size of many of today's electronic components, maintaining reliable electrical contact between components, such as between an integrated circuit and a printed circuit board, has become very difficult. A component providing such connection must be a conductive material, as well as provide a minimum force to maintain the electrical contact. One solution for providing reliable electrical contact between a circuit board and another component is to use an interposer device comprising a plurality of very small metal springs, i.e., microsprings. However, the mechanical properties of individual metals may be inadequate to properly form such microsprings. For example, copper may prove too soft, while nickel may prove too brittle. It has been found that by fabricating such microsprings from a combination of metals, rather than from a single metal, some of the spring properties of the resulting composition are improved. Such an interposer device comprising microsprings formed from multiple layers of metals is disclosed in commonly assigned U.S. patent application Ser. No. 09/454,804, filed Dec. 3, 1999, entitled "Metallic Microstructure Spring now U.S. Pat. No. 6,442,039."

In addition to facilitating the manufacture of extremely small mechanical and electrical components, contemporary integrated circuit fabrication techniques also facilitate the mass production of such devices. Further, photolithographic techniques, such as those commonly used in the fabrication of integrated circuits, readily lend themselves to the mass production of extremely small mechanical and electrical components. According to such contemporary photolithographic techniques, thousands, possibly millions of very small components can be fabricated simultaneously.

Although such photolithographic techniques have proven generally useful for the fabrication of microelectro mechanical system components, such contemporary fabrication techniques suffer from inherent deficiencies. For example, although contemporary photolithographic techniques are well understood and reliable, they utilize comparatively expensive equipment and processes. Further, contemporary photolithographic techniques are not well suited for forming out-of-plane features, such as raised features and depressed features. Although contemporary photolithographic procedures may be utilized to form such out-of-plane structures, the use of such contemporary photolithographic procedures to form such out-of-plane features substantially complicates the process, and thus likewise substantially increases the cost thereof.

Small mechanical features are typically plated or sputtered so as to form components. Typically, printed circuits are made from metal foils which are etched so as to define the desired circuits and/or structures. Generally, nanolaminates are formed via sputtering. However, as those skilled in the art will appreciate, sputtering is an expensive process and currently is only capable of creating nanolaminate structures of a limited size.

Although it is known to use electrolytic plating processes to form nanolaminate materials, only voltage/potential control of the electrolytic plating process has thus far been utilized to create such structures. As those skilled in the art will appreciate, the use of voltage/potential control requires that the electrolytic bath have three separate electrodes, i.e., an anode, a cathode, and a reference electrode. Such a three-electrode electroplating system is primarily only useful in laboratory situations and does not lend itself well to high-volume plating processes. For example, the required presence of the third electrode, and its necessary proximity to the cathode, greatly reduces the size of the materials which may be plated.

Electrolytic plating techniques for forming very thin layers of metals upon a substrate are well known. Such contemporary electrolytic plating techniques are commonly utilized for applying very thin layers of highly conductive materials such as gold, silver and platinum upon less conductive materials such as copper, for example.

In view of the foregoing, it is desirable to provide a method for forming nanolaminate structures utilizing a simple and comparatively inexpensive plating process, wherein structures having comparatively large surface areas can be plated in a reliable and economically feasible manner.

SUMMARY OF THE INVENTION

The present invention is directed to a method for forming nanolaminate structures. The method comprises plating a cathode with at least one layer of a first metal, and at least one layer of a second metal, using an electrolytic plating process. The plating current is controlled to maintain the current density at the electrode within a predefined range.

BRIEF DESCRIPTION OF THE DRAWINGS

The features, aspects, and advantages of the present invention will be more fully understood when considered with respect to the following detailed description, appended claims and accompanying drawings, wherein:

DETAILED DESCRIPTION

Figure 1:
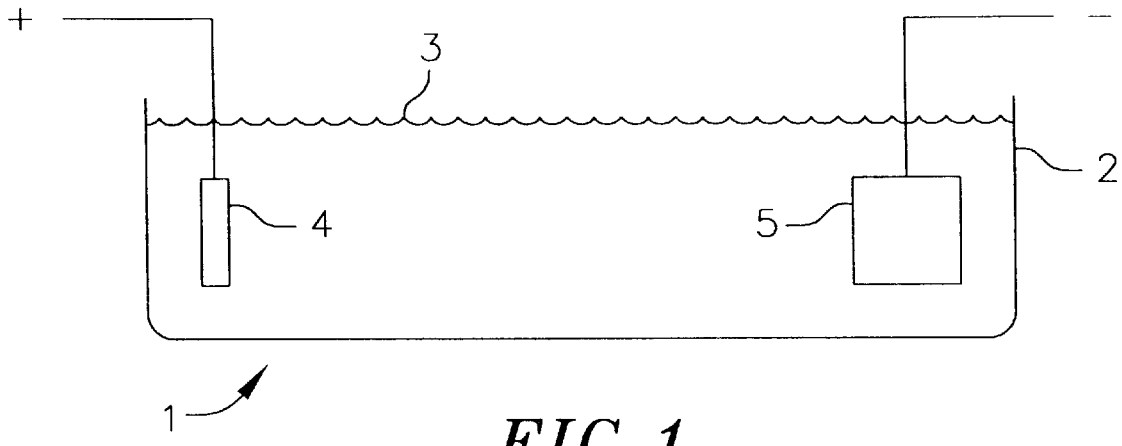
FIG. 1 is a semi-schematic diagram of an electrolytic plating bath, wherein a structure defining a cathode thereof is capable of having a comparatively large surface area, as compared to cathodes utilized according to contemporary methodology.

The detailed description set forth below in connection with the appended drawings is intended as a description of the presently preferred embodiments of the invention, and is not intended to represent the only form in which the present invention may be constructed or utilized. The description sets forth the construction and functions of the invention, as well as the sequence of steps for operating the invention in connection with the illustrated embodiments. It is to be understood, however, that the same or equivalent functions may be accomplished by different embodiments that are also intended to be encompassed within the spirit and scope of the invention.

The present invention comprises a method for forming nanolaminate structures. The method comprises plating a cathode with a plurality of alternating nanolayers of a first metal and a second metal. The cathode is plated using an electrolytic plating process, wherein the plate current, and thereby the current density of the electrolytic process, is controlled such that the current density at the electrolytic cell cathode is maintained within a predefined range. It will be appreciated by those skilled in the art that current density is the plating current, divided by the plating area. Thus, by knowing the surface area of the substrate which is to be plated, and controlling the plating current, the current density may be maintained at desired levels.

Nanolaminates may comprise up to 1000, 5000 or even 10,000 or more metallic nanolayers, with each layer being less than approximately 1000 nanometers, i.e., 1 micron, in thickness. By controlling the thickness of the layers between approximately 0.5 and 1000 nanometers, preferably between 0.8 and 100 nanometers, a dramatic improvement in the mechanical properties of the nanolaminate, as compared to the mechanical properties of either of the individual constituent metals, is achieved. Such nanolayers are preferably formed by plating metals onto a substrate, in accordance with practice of the present invention.

The yield strength, hardness, modulus of elasticity, elongation and other properties of the resulting nanolaminate structure may all be controlled by controlling the thickness of the metal layers. Thus nanolaminate structures are extremely well suited to such microscopic applications as forming conductive spring structures in an interposer. By using nanolaminates, and controlling the thickness of the metal layers, microscopic structures are created having desired mechanical properties, such as springs having desired size, force and elasticity characteristics. Depending on the application, particular electrical or magnetic characteristics may also be desired, which may also be produced by controlling the layer thickness within the nanolaminate.

By controlling individual layer thickness in a nanolaminate, the mechanical properties of the laminate may be improved over the same mechanical properties of the individual metals or alloys comprising the layers of the nanolaminate. For example, while the yield strength of copper is approximately 6,000 psi, and the yield strength of nickel is approximately 30,000 psi, and the yield strength of a 99% nickel-1% copper alloy is approximately 29,700 psi, the yield strength of a nanolaminate formed of nanolayers of copper and nickel-copper alloy may be improved by greater than a factor of 10, with the yield strength of the nanolaminate approaching 400,000 psi.

A bath containing ions of a first metal and a second metal is provided and a substrate which acts as a cathode is placed at least partially within the bath, so as to effect plating of the substrate with metal from the bath. The two metals preferably comprise a more noble metal and a less noble metal, such as copper and nickel, respectively. A parameter of the plating process, preferably plating current density, is controlled in a manner which results in control of which of the two metals is being plated at a particular time. As noted above, knowing the plating area of the substrate, one may control the plating current in order to achieve the desired current density. For example, the plating current may be controlled in a manner which results in a layer of the more noble metal being deposited while substantially none of the less metal is deposited, and then the plating current may be adjusted in a manner in which results in a layer of an alloy of the more noble metal and the less noble metal being deposited. It will be appreciated by those skilled in the art that the current densities at which the particular metals or alloys will plate out in a particular solution may be determined through use of a Hull Cell. While this technique is well known to those skilled in the art, additional information is set forth in the article Sanicky, Marilyn K., "A Versatile Plater's Tool: All About the Hull Cell," *Plating and Surface Finishing,* October 1985, which is herein incorporated by reference.

Using the Hull Cell, one may determine the critical current density below which the more noble metal plates, and at which substantially none of the less noble metal plates, and above which both metals will be plated as an alloy comprised substantially of the less noble metal. For example, in the case of a bath containing copper and nickel ions, in a ratio of approximately 1:100 respectively, it has been discovered that 1.5 amps/ft$^2$ is the critical current density. At a current density below this, preferably a current density of approximately 1.0 amps/ft$^2$, substantially only copper, the more noble metal, will plate. However, at a current density above this, preferably a current density of approximately 2.5 to 25 amps/ft$^2$, both copper and nickel will plate, resulting in an alloy approximately 99% nickel and 1% copper.

It will be appreciated by those skilled in the art that in addition to the use of a Hull Cell, the critical current density may be obtained by any other method known to those skilled in the art. Once the critical current density is determined, above which an alloy of the more noble and less noble metals plates out, and below which only the more noble metal plates out, a desired range of current densities is defined, both above and below the critical current density. Knowing the plating area of the substrate to be plated, one may then control the plating current to maintain the current density within the predefined range. By varying the plating current, and thereby changing the current density, alternating layers of substantially 1) the more noble metal, and 2) the alloy of both metals may be plated out. It will be appreciated by those skilled in the art that in addition to using a variety of metals and or alloys, the concentrations of the metal ions may also be varied, depending on the specific properties desired.

This process is repeated to facilitate the formation of a plurality of alternating layers of 1) the more noble metal, and 2) the alloy of both metals. The ratio of the more noble metal to the less noble metal in the alloy can be controlled by controlling the concentration of the ions of the more noble metal in the bath. In a preferred embodiment, the concentration of copper ions to nickel ions in the plating bath is 1%, or a ratio of 1:100, resulting in plating layers of copper and nickel-copper alloy, respectively, where the alloy is approximately 99% nickel and 1% copper. It will be appreciated by those skilled in the art that the ions in the bath may be provided by salts of the metals, such as copper sulfate, and that other metals may also be used in addition to, or in place of copper and nickel. It will be further appreciated that there are several approaches to controlling the proper ion concentration in the bath. In the preferred embodiment, an inert anode is utilized, and as ions are plated onto the cathode, i.e., the substrate, they are depleted from the solution. It has been found through use of a Hull Cell that a change in the ion concentration of approximately ±5% has little or no effect on the plating. Thus, plating may continue until such ions are depleted from the bath to change the concentration by ±5%, at which time the ions in the bath must be replenished. It will be appreciated by those skilled in the art that the concentrations of the respective ions in the bath may be properly maintained by "on the fly" addition of solution to the bath so that the plating process will not be interrupted.

It will be further appreciated by those skilled in the art that other methods of maintaining proper ion concentration may be used, such as, for example, replacing the inert anode with an alloy anode that corresponds to the respective ion concentrations in the bath.

In one exemplary embodiment, the substrate onto which the metallic nanolayers are plated comprises a mandrel. It will be appreciated by those skilled in the art that this substrate can include any conductive surface, such as metals, films, metallized plastics or any other conductive surface known in the art. It will be further appreciated that "mandrel" is used in the broadest sense of the word, as known to those skilled in the art, to include such other conductive surfaces. By using a mandrel, and plating the layers of metal(s) onto the mandrel, a variety of shapes of nanolaminates may be formed. By forming indentations or protrusions on the mandrel, corresponding structures are formed on the nanolaminate. By use of etching or other conventional techniques, portions of the layer may be removed, so that the resulting nanolaminate structure may be in a variety of forms, such as a spring.

In the preferred embodiment, the mandrel is a stainless steel plate or sheet. The thickness of the mandrel may vary, depending on the application. In one embodiment, the mandrel is a 1/16 inch thick plate. In another embodiment, the mandrel is a 1/32 inch thick sheet. It will be appreciated by those skilled in the art that in another embodiment, the mandrel has two parallel plating surfaces, bonded to a core, and that in other embodiments, the number of plating surfaces is be varied depending on the particular application.

Out-of-plane features, dimensional features which either protrude or recess, are formed in the nanolaminate structure by providing a mandrel having corresponding, i.e., mirror image, out-of-plane features formed thereon. Thus, raised features may be formed in the nanolaminate structure by providing a mandrel having complimentary depressed features formed therein. Similarly, depressed features may be formed in the nanolaminate structure by providing a mandrel having complimentary raised features formed therein. The mandrel may have both raised and depressed features formed therein, so as to effect the formation of both depressed and raised features in the nanolaminate structure. The raised and/or depressed features may be formed in the mandrel using various processes, including mechanical deformation, extrusion, machining, laser ablation or other techniques known in the art.

The use of such a mandrel having out-of-plane features thus facilitates the formation of nanolaminate structures having corresponding out-of-plane features in a manner which is comparatively simple and inexpensive, particularly when compared with the complexity and cost associated with forming such features via contemporary photolithographic processes.

The substrate, i.e., mandrel, is plated according to a predefined pattern. The pattern may be defined by providing a mask for the mandrel, such that the mandrel is only plated in desired areas, i.e., according to the predefined pattern. It will be appreciated by those skilled in the art that the pattern to be plated may also be defined by using photoresist and developing the same to create a pattern for plating, or any other technique known in the art for creating electrically conductive patterns or shapes.

According to the present invention, the thickness of the nanolaminate structure, preferably the thickness of each nanolayer of the nanolaminate structure, is controlled so as to provide a nanolaminate structure having a modulus of elasticity or other mechanical property with approximately a desired value. As those skilled in the art will appreciate, the thickness of the layers is controlled by a combination of factors, including time in the bath, temperature, ion concentration, and current. For example, when using a bath of nickel and copper ions in a ratio of 100:1, respectively, the copper plates out at a much lower current density than the nickel-copper alloy. Thus while it may take 20 seconds to plate a layer of copper, it may only take 1 second to plate a layer of the nickel-copper alloy. It will be further appreciated that selection of these factors may depend on the particular application and metal(s) being used, and thus various factors may be adjusted to arrive at the desired layer thickness. Thus, according to the present invention, mechanical properties of the nanolaminate structure may be controlled by controlling the thickness of the layers which define the nanolaminate structure.

Referring now to FIG. 1, an electrolytic plating cell or bath 1 comprises an enclosure 2 which is suitable for containing a liquid electrolytic solution 3. A predefined constant current is applied to the anode 4 and the cathode 5.

The electrolytic solution 3 contains ions of the metals which are to be plated onto the cathode 5. The plating current, and thus the current density between the anode 4 and the cathode 5 is controlled, as described in detail below, in a manner such that a cathode 5 having a comparatively large surface area (as compared to the surface area of contemporary cathodes) may be plated. It will be appreciated by those skilled in the art that by using a relatively large cathode, as compared to the previous practice of using a relatively small cathode having a plating surface area of approximately 1 square inch, and by eliminating the necessity of a third electrode in close proximity to the cathode, much greater areas may be plated than previously. For example, it is contemplated that cathodes having surface area of approximately 2 to 4 $ft^2$ or more may be plated in accordance with the present invention.

The cathode 5 preferably comprises a mandrel, and may have out-of-plane surface features, as described in detail below. According to the present invention, metal ions from the electrolytic bath 3 are deposited upon the cathode, e.g., the mandrel, preferably in alternating layers thereof, so as to define a nanolaminate structure. The nanolaminate structure may either be removed from the cathode or the cathode may be sacrificed, such as via acid etching.

According to the present invention, current between the anode 4 and the cathode 5 is controlled so as to maintain a desired current density, and likewise control the plating process. The plating current is controlled during plating period such that the current density for the half-cell reaction at the cathode is within the current density requirements, as determined by the Hull Cell or other method, which are required to plate the metal or alloy desired.

Thus, either substantially pure metal or an alloy of metals may be plated at any desired time. For example, it is described in accordance with the present invention to alternately plate layers of substantially pure metal and alloy so as to form a plurality of alternating layers thereof.

A hull cell may be utilized to determine the current where cessation of plating of the less noble metal will occur. By periodically varying the current at the cathode above and below this critical current, the nanolaminate layers can be formed onto a larger area cathode. As those skilled in the art will appreciate, the ability to plate such comparatively large area cathodes makes the plating process of the present invention substantially more amenable to commercial applications.

For example, using a 100:1 nickel to copper ion solution, it has been determined that the critical current density is approximately 1.5 amps/ft$^2$, and thus the current density must be cycled above and below this value to effect plating of both copper and nickel-copper alloy layers.

Figure 2:
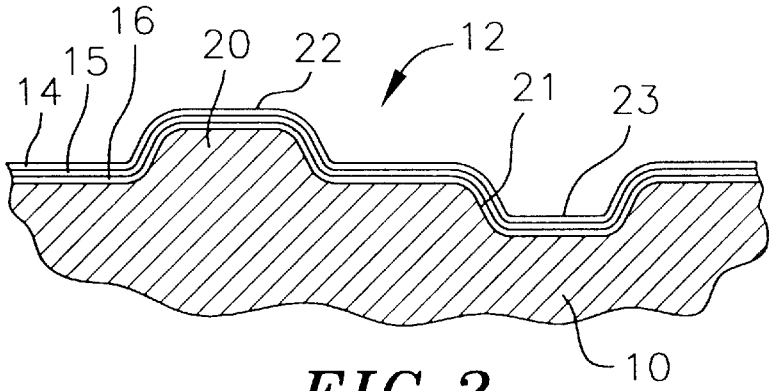
FIG. 2 is a semi-schematic cross-sectional side view of a mandrel having out-of-plane features, wherein the mandrel is being used to form a nanolaminate structure having corresponding, i.e., mirror image, out-of-plane features.

Referring now to FIG. 2, a mandrel 10 has a plurality of plated layers 14, 15, and 16, formed thereupon so as to define a nanolaminate structure 12. The nanolaminate structure has out-of-plane features, such as raised feature 22 formed by corresponding raised portion 20 of the mandrel 10 and depressed feature 23 formed by corresponding depressed portion 21 of the mandrel 10.

The nanolaminate structure 12 is formed upon the mandrel 10 utilizing an electrolytic plating process, as described in detail below.

Figure 3:
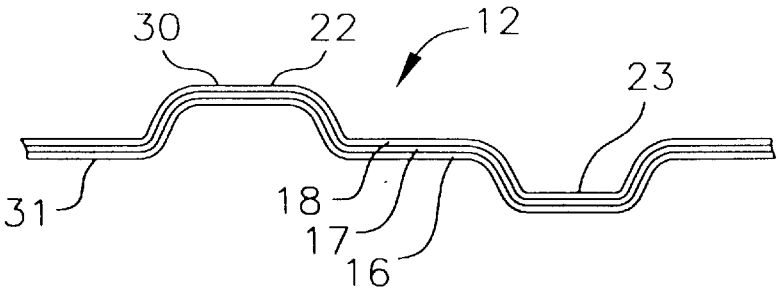
FIG. 3 is a semi-schematic cross-sectional side view of a nanolaminate structure such as that formed utilizing the mandrel of FIG. 2.

Referring now to FIG. 3, the nanolaminate structure 12 has been removed from the mandrel 10. The nanolaminate structure may be attached to a backing substrate or another component, via either the upper 30 or lower 31 surface thereof, as desired.

As those skilled in the art will appreciate, such a nanolaminate structure may be utilized to form various different desired structural and/or electrical components. According to the present invention, mechanical properties of the nanolaminate structure 12 are controlled, so as to facilitate the fabrication of a nanolaminate structure having such desired properties. For example, the modulus of elasticity may be controlled by varying the thickness of the layers which comprise the nanolaminate layers 14, 15 and 16, which comprise the nanolaminate structure 12. In one embodiment, the nanolaminate structure comprises alternating layers of 1) a more noble metal, such as copper, and 2) an alloy of a more noble metal and a less noble metal, such as nickel-copper alloy, which may be substantially nickel. The thickness of each of the individual layers determines the value of the desired mechanical property. While the illustrated nanolaminate structure is shown having only three layers for simplicity, it should be understood that nanolaminate structures having 100, 500, or up to more than 1000 layers, each having a thickness of less than 1 micron, can be provided in accordance with practice of the present invention.

Figure 4:
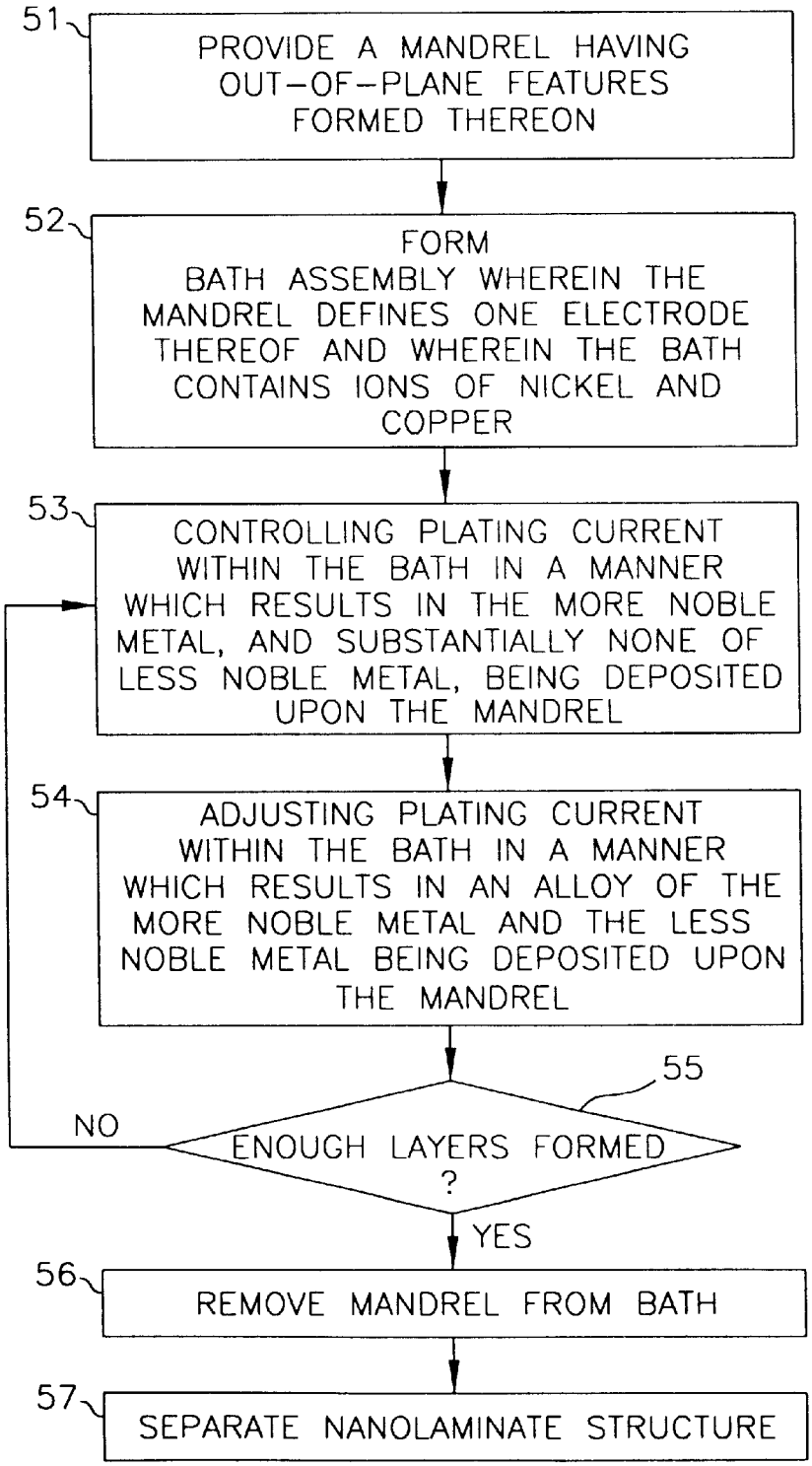
FIG. 4 is a flow chart showing the process of forming a nanolaminate structure according to the present invention.

Referring now to FIG. 4, the nanolaminate structure 12 of FIGS. 1 and 2 is formed by providing a mandrel having out-of-plane features, as shown in block 51.

As shown in block 52, an electrolytic plating bath assembly is formed such that the mandrel 10 defines one electrode thereof. The electrolytic plating bath preferably comprises ions of two different metals, wherein one of the metals is more noble than the other metal. For example, in the illustrated embodiment, the bath comprises ions of the more noble metal copper and ions of the less noble metal nickel.

As shown in block 53, the plating current of the bath is controlled in a manner which results in a layer comprising substantially only the more noble metal, i.e., copper, being deposited upon the mandrel. Then, the plating current is adjusted within the bath in a manner which results in an alloy of the more noble metal and the less noble metal being deposited upon the mandrel 10. Alternatively, the alloy may be deposited upon the mandrel before the more noble metal is deposited thereupon.

In either instance, the process of adjusting the current to alternately plate layers of 1) the more noble metal and 2) the alloy of both metals is continued until the desired number of such layers is formed upon the mandrel. As was set forth above, the cycle time, ion concentration, and current density are set to obtain the desired layer thickness.

For example, in one particular embodiment of the present invention, a bath of nickel and copper ions in the concentration of 15.2 oz. nickel ions/gal. solution:0.117 oz. copper ions/gal solution were used. The copper was provided by copper sulfate, while the nickel was provided by nickel sulfamate. The bath also contained sodium dodecyl sulfate. A 316 S/S mandrel, 0.060 inch thick was used, having a surface area of 25 in$^2$. The mandrel was placed in the bath at a current of 0.260 amps. The current was kept at this setting for approximately 16.8 seconds, plating a layer of copper approximately 20 nanometers thick. The current was then changed to 2.60 amps for approximately 3.59 seconds. This resulted in plating of a layer of nickel-copper alloy approximately 20 nanometers thick. This process was repeated until 635 total alternating layers were formed into a nanolaminate structure. During the plating procedure, the concentration of the electrolytic plating bath was maintained by adding 2.21 ml of a copper sulfate solution comprising 10 oz. of copper metal per gallon and 0.91 ml of a nickel sulfamate solution comprising 24 oz. of nickel metal per gallon at intervals of 20.05 minutes.

After the desired number of layers have been formed upon the mandrel, a backing substrate for the nanolaminate structure may optionally be formed upon the nanolaminate structure, preferably while the nanolaminate structure is still attached to the mandrel.

As shown in FIGS. 2 and 3, the nanolaminate structure 12 is removed from the mandrel 10, and may be processed further, as desired and/or assembled along with other components.

Those skilled in the art will appreciate that the method for forming a nanolaminate structure of the present invention may be utilized along with various other technologies, so as to define the desired structure. For example, laser etching, ion milling, as well as various photolithographic techniques may be utilized so as to further define the desired features of the nanolaminate structure of the present invention.

It will be further appreciated that the steps of the method may be practiced in various orders. For example, a backing substrate, such as a flexible polymer, may be formed to the nanolaminate either before or after the nanolaminate is removed from the mandrel. In addition, masking and etching steps may be performed before or after a backing substrate is formed to the nanolaminate, and before or after the nanolaminate is removed from the mandrel.

The above descriptions of exemplary embodiments of methods for forming nanolaminate structures are illustrative of the present invention. Because of variations which will be apparent to those skilled in the art, however, the present invention is not intended to be limited to the particular embodiments described above. The scope of the invention is defined in the following claims.

What is claimed is:

1. A method for forming a nanolaminate structure, the method comprising:

providing a bath containing ions of a first metal and ions of a second metal;

placing a substrate which acts as a cathode at least partially within the bath;

plating the cathode with one layer of substantially the first metal to a first metal thickness and one layer of substantially the second metal to a second metal thickness, using an electrolytic plating process; and repeating said plating steps to obtain a predetermined number of layers;

wherein a plating current is controlled to obtain a desired current density at the cathode within a predefined range, and wherein at least one of the first metal thickness and the second metal thickness are less than 100 nanometers.

2. The method as recited in claim 1, further comprising periodically changing the current to thereby change the current density at the cathode to a value which is above a critical current density and then to a value which is below a critical current density.

3. The method as recited in claim 1, wherein the cathode comprises a mandrel.

4. The method as recited in claim 1, wherein the cathode comprises a mandrel having one or more out-of-plane features formed thereon so as to effect formation of a nanolaminate structure having one or more out-of-plane features.

5. The method as recited in claim 4, wherein the out-of-plane features of the nanolaminate structure replicate the surface of the mandrel.

6. The method as recited in claim 4, wherein the out-of-plane features of the mandrel comprise raised features.

7. The method as recited in claim 6, wherein the out-of-plane features of the mandrel comprise depressed features.

8. The method as recited in claim 1, wherein the cathode is plated according to a predefined pattern.

9. The method as recited in claim 1, wherein the thickness of the layer(s) of the first or second metal is controlled so as to provide a nanolaminate having a modulus of elasticity with approximately a desired value.

10. The method as recited in claim 1, wherein the thickness of the layer(s) of the first or second metal is controlled so as to provide a nanolaminate having a yield strength with approximately a desired value.

11. The method as recited in claim 1, wherein the thickness of the layer (s) of the first or second metal is controlled so as to provide a nanolaminate having a hardness with approximately a desired value.

12. The method as recited in claim 1, wherein the thickness of each of the layers of the first and second metals is less than 1000 nanometers.

13. The method as recited in claim 1, wherein the plating current is further controlled such that the plating current is alternately adjusted within said predefined range to a value which results in a layer of substantially the first metal being plated on the cathode and then to a value which results in substantially the second metal being plated on the cathode.

14. The method as recited in claim 1, wherein the at least one layer of substantially a second metal being in the form of an alloy of the first and second metals.

15. A method for forming a nanolaminate structure, the method comprising: defining a conductive pattern on a mandrel; plating the conductive pattern on the mandrel with a plurality of alternating layers of substantially a first metal and substantially a second metal so as to at least partially define the nanolaminate structure; and separating the nanolaminate structure from the mandrel; wherein plating the mandrel comprises providing a bath containing ions of the first metal and ions of the second metal, placing the mandrel which acts as a cathode at least partially within the bath, and controlling a plating current such that a current density at the cathode is maintained within a predefined range.

16. The method as recited in claim 15, wherein at least 100 layers are plated.

17. The method as recited in claim 15, wherein about 100 to 1000 layers are plated.

18. The method as recited in claim 15, wherein about 1000 to 10000 layers are plated.

19. The method as recited in claim 15, wherein each layer is less than 1000 nanometers in thickness.

20. The method as recited in claim 15, further comprising forming a backing substrate to the nanolaminate.

21. A method for forming a nanolaminate structure, the method comprising:

providing a bath containing ions of a more noble metal and ions of a less noble metal;

placing a substrate which acts as a cathode at least partially within the bath;

plating the cathode with one layer of substantially the more noble metal and substantially none of the less noble metal to a metal thickness and one layer of an alloy of the more noble and less noble metals to an alloy thickness, using an electrolytic plating process; and repeating said plating steps to obtain a predetermined number of layers;

wherein a plating current is controlled to obtain a desired current density at the cathode within a predefined range and wherein at least one of the metal thickness and the alloy thickness are less than 100 nanometers.

22. The method as recited in claim 21, further comprising periodically changing the current to thereby change the current density at the cathode to a value which is above a critical current density and then to a value which is below a critical current density.

23. The method as recited in claim 21, wherein the cathode comprises a mandrel.

24. The method as recited in claim 21, wherein the cathode comprises a mandrel having one or more out-of-plane features formed thereon so as to effect formation of a nanolaminate structure having one or more out-of-plane features.

25. The method as recited in claim 21, wherein the cathode is plated according to a predefined pattern.

26. The method as recited in claim 21, wherein the thickness of the layer(s) of the substantially more noble metal and substantially none of the less noble metal and the layer(s) of the alloy of the more noble and less noble metals is controlled so as to provide a nanolaminate having a modulus of elasticity with approximately a desired value.

27. The method as recited in claim 21, wherein the thickness of the layer(s) of the substantially more noble metal and substantially none of the less noble metal and the layer(s) of the alloy of the more noble and less noble metals is controlled so as to provide a nanolaminate having a yield strength with approximately a desired value.

28. The method as recited in claim 21, wherein the thickness of the layer(s) of the substantially more noble metal and substantially none of the less noble metal and the layer(s) of the alloy of the more noble and less noble metals is controlled so as to provide a nanolaminate having a hardness with approximately a desired value.

29. The method as recited in claim 21, wherein the thickness of the layer(s) of the substantially more noble metal and substantially none of the less noble metal and the layer(s) of the alloy of the more noble and less noble metals is less than 1000 nanometers.

30. The method as recited in claim 21, wherein the plating current is further controlled such that the plating current is alternately adjusted within said predefined range to a value which results in a layer of substantially the more noble metal and substantially none of the less noble metal being plated on the cathode and then to a value which results in an alloy of the more noble and less noble metals being plated on the cathode.

31. A method for forming a nanolaminate structure, the nanolaminate structure comprising at least one layer of substantially a first metal having an individual layer thickness of 1000 nanometers or less, adjacent at least one layer of an alloy of the first metal and a second metal having an individual layer thickness of 1000 nanometers or less, the method comprising:

defining a conductive pattern on a mandrel;

plating the conductive pattern on the mandrel with a plurality of alternating layers of substantially the first metal and the alloy of the first metal and the second metal so as to at least partially define the nanolaminate structure; and separating the nanolaminate structure from the mandrel;

wherein plating the mandrel comprises providing a bath containing ions of the first metal and ions of the second metal, placing the mandrel which acts as a cathode at least partially within the bath, and controlling a plating current such that a current density at a cathode is maintained within a predefined range.

32. The method as recited in claim 31, further comprising forming a backing substrate to the nanolaminate.

* * * * *